US006482315B1

(12) United States Patent
Roberie et al.

(10) Patent No.: US 6,482,315 B1
(45) Date of Patent: Nov. 19, 2002

(54) GASOLINE SULFUR REDUCTION IN FLUID CATALYTIC CRACKING

(75) Inventors: Terry G. Roberie, Ellicott City, MD (US); Ranjit Kumar, Clarksville, MD (US); Michael Scott Ziebarth, Columbia, MD (US); Wu-Cheng Cheng, Ellicott City, MD (US); Xinjin Zhao, Woodbine, MD (US); Nazeer Bhore, Gaithersburg, MD (US)

(73) Assignee: W.R. Grace & Co.-Conn., Columbia, MD (US)

( * ) Notice: Subject to any disclaimer, the term of this patent is extended or adjusted under 35 U.S.C. 154(b) by 0 days.

(21) Appl. No.: 09/649,627

(22) Filed: Aug. 28, 2000

Related U.S. Application Data

(63) Continuation-in-part of application No. 09/399,637, filed on Sep. 20, 1999.

(51) Int. Cl.[7] ..... C10G 29/04
(52) U.S. Cl. ..... 208/249; 208/248; 208/208 R
(58) Field of Search ..... 208/249, 248, 208/208 R

(56) References Cited

U.S. PATENT DOCUMENTS

| | | | | | |
|---|---|---|---|---|---|
| 3,293,192 | A | | 12/1966 | Maher et al. | 252/430 |
| 3,402,996 | A | | 9/1968 | Maher et al. | 23/112 |
| 3,607,043 | A | | 9/1971 | McDaniel et al. | 23/111 |
| 3,676,368 | A | | 7/1972 | Scherzer et al. | 252/455 Z |
| 3,977,963 | A | | 8/1976 | Readal et al. | 208/120 |
| 4,464,252 | A | * | 8/1984 | Eberly, Jr. et al. | 208/243 |
| 4,489,169 | A | | 12/1984 | Bertus et al. | 502/64 |
| 4,588,702 | A | * | 5/1986 | Beck et al. | 502/65 |
| 4,615,996 | A | * | 10/1986 | Occelli | 502/65 |
| 4,642,177 | A | | 2/1987 | Mester et al. | 208/113 |
| 4,790,982 | A | | 12/1988 | Yoo et al. | 423/239 |
| 4,846,960 | A | | 7/1989 | Walker et al. | 208/119 |
| 4,943,366 | A | | 7/1990 | Fischer et al. | 208/68 |
| 4,944,864 | A | * | 7/1990 | Kugler | 208/120 |
| 4,946,578 | A | * | 8/1990 | Clough et al. | 208/46 |
| 4,957,718 | A | | 9/1990 | Yoo et al. | 423/244 |
| 4,957,892 | A | | 9/1990 | Yoo et al. | 502/63 |
| 4,963,520 | A | | 10/1990 | Yoo et al. | 502/64 |
| 4,988,654 | A | * | 1/1991 | Kennedy et al. | 502/84 |
| 5,002,653 | A | * | 3/1991 | Kennedy et al. | 208/118 |
| 5,098,684 | A | | 3/1992 | Kresge et al. | 423/277 |
| 5,102,643 | A | | 4/1992 | Kresge et al. | 423/328 |
| 5,198,203 | A | | 3/1993 | Kresge et al. | 423/718 |
| 5,376,608 | A | | 12/1994 | Wormsbecher et al. | 502/61 |
| 5,399,327 | A | | 3/1995 | Kim | 423/244.11 |
| 5,407,878 | A | | 4/1995 | Kim | 502/41 |
| 5,525,210 | A | | 6/1996 | Wormsbecher et al. | 208/122 |
| 5,547,564 | A | | 8/1996 | Cheng et al. | 208/122 |
| 5,604,173 | A | * | 2/1997 | Bouyanov et al. | 502/354 |
| 5,618,406 | A | | 4/1997 | Demmel | 208/48 R |
| 6,048,821 | A | * | 4/2000 | Demmel et al. | 502/439 |
| 6,074,984 | A | * | 6/2000 | Demmel et al. | 502/439 |
| 6,156,696 | A | * | 12/2000 | Albers et al. | 502/339 |

FOREIGN PATENT DOCUMENTS

| | | |
|---|---|---|
| GB | 2341191 | 3/2000 |

OTHER PUBLICATIONS

T. Myrstad, B. Seljestokken, H. Engan, E. Rytter, "Effect of Nickel and Vanadium on Sulphur Reduction of FCC Naphtha", Applied Catalysis A: General 192 (2000) 299–305, no month.

Refining Catalyst News, Grace Davison Refining Catalysts Europe, Jul. 1999 (Issue No. 3), pp. 1–2.

P–O.F. Andersson, M. Pirjamali, S.G. Järås, M. Boutonnet–Kizling, "Cracking Catalyst Additives for Sulfur Removal from FCC Gasoline", Catalysis Today 53 (1999) 565–573, no month.

A. Haas, D. A. Harding, J.R.D. Nee, M. Perez Pascual, "New Catalyst Technology for Gasoline Sulphur Reduction", Catalagram, European Edition Feb. 1999, pp. 15–17, no month.

* cited by examiner

*Primary Examiner*—Nadine G. Norton
(74) *Attorney, Agent, or Firm*—Beverly J. Artale

(57) ABSTRACT

The sulfur content of liquid cracking products, especially the cracked gasoline, of the catalytic cracking process is reduced by the use of a sulfur reduction additive comprising a non-molecular sieve support containing a high content of vanadium. Preferably, the support is alumina. The sulfur reduction catalyst is used in the form of a separate particle additive in combination with the active catalytic cracking catalyst (normally a faujasite such as zeolite Y) to process hydrocarbon feedstocks in the fluid catalytic cracking (FCC) unit to produce low-sulfur gasoline and other liquid products.

26 Claims, No Drawings

GASOLINE SULFUR REDUCTION IN FLUID CATALYTIC CRACKING

CROSS-REFERENCE TO RELATED APPLICATIONS

This application is a continuation in part to application Ser. No. 09/399,637, filed Sep. 20, 1999.

FIELD OF THE INVENTION

This invention relates to the reduction of sulfur in gasoline and other petroleum products produced by a catalytic cracking process. The invention provides a catalytic composition for reducing product sulfur and a process for reducing product sulfur using this composition.

BACKGROUND OF THE INVENTION

Catalytic cracking is a petroleum refining process which is applied commercially on a very large scale. A majority of the refinery gasoline blending pool in the United States is produced by this process, with almost all being produced using the fluid catalytic cracking (FCC) process. In the catalytic cracking process heavy hydrocarbon fractions are converted into lighter products by reactions taking place at elevated temperature in the presence of a catalyst, with the majority of the conversion or cracking occurring in the vapor phase. The feedstock is thereby converted into gasoline, distillate and other liquid cracking products as well as lighter gaseous cracking products of four or less carbon atoms per molecule. The gas partly consists of olefins and partly of saturated hydrocarbons.

During the cracking reactions some heavy material, known as coke, is deposited onto the catalyst. This reduces the activity of the catalyst and regeneration is desired. After removal of occluded hydrocarbons from the spent cracking catalyst, regeneration is accomplished by burning off the coke to restore catalyst activity. The three characteristic steps of the catalytic cracking can be therefore be distinguished: a cracking step in which the hydrocarbons are converted into lighter products, a stripping step to remove hydrocarbons adsorbed on the catalyst and a regeneration step to burn off coke from the catalyst. The regenerated catalyst is then reused in the cracking step.

Catalytic cracking feedstocks normally contain sulfur in the form of organic sulfur compounds such as mercaptans, sulfides and thiophenes. The products of the cracking process correspondingly tend to contain sulfur impurities even though about half of the sulfur is converted to hydrogen sulfide during the cracking process, mainly by catalytic decomposition of non-thiophenic sulfur compounds. The distribution of sulfur in the cracking products is dependent on a number of factors including feed, catalyst type, additives present, conversion and other operating conditions but, in any event a certain proportion of the sulfur tends to enter the light or heavy gasoline fractions and passes over into the product pool. With increasing environmental regulation being applied to petroleum products, for example in the Reformulated Gasoline (RFG) regulations, the sulfur content of the products has generally been decreased in response to concerns about the emissions of sulfur oxides and other sulfur compounds into the air following combustion processes.

One approach has been to remove the sulfur from the FCC feed by hydrotreating before cracking is initiated. While highly effective, this approach tends to be expensive in terms of the capital cost of the equipment as well as operationally since hydrogen consumption is high. Another approach has been to remove the sulfur from the cracked products by hydrotreating. Again, while effective, this solution has the drawback that valuable product octane may be lost when the high octane olefins are saturated.

From the economic point of view, it would be desirable to achieve sulfur removal in the cracking process itself since this would effectively desulfurize the major component of the gasoline blending pool without additional treatment. Various catalytic materials have been developed for the removal of sulfur during the FCC process cycle, but, so far most developments have centered on the removal of sulfur from the regenerator stack gases. An early approach developed by Chevron used alumina compounds as additives to the inventory of cracking catalyst to adsorb sulfur oxides in the FCC regenerator; the adsorbed sulfur compounds which entered the process in the feed were released as hydrogen sulfide during the cracking portion of the cycle and passed to the product recovery section of the unit where they were removed. See Krishna et al, *Additives Improve FCC Process,* Hydrocarbon Processing, November 1991, pages 59–66. The sulfur is removed from the stack gases from the regenerator but product sulfur levels are not greatly affected, if at all.

An alternative technology for the removal of sulfur oxides from regenerator stack gases is based on the use of magnesium-aluminum spinels as additives to the circulating catalyst inventory in the FCCU. Under the designation DESOX™ used for the additives in this process, the technology has achieved a notable commercial success. Exemplary patents disclosing this type of sulfur removal additives include U.S. Pat. Nos. 4,963,520; 4,957,892; 4,957,718; 4,790,982 and others. Again, however, product sulfur levels are not greatly reduced.

A catalyst additive for the reduction of sulfur levels in the liquid cracking products was proposed by Wormsbecher and Kim in U.S. Pat. Nos 5,376,608 and 5,525,210, using a cracking catalyst additive of an alumina-supported Lewis acid for the production of reduced-sulfur gasoline but this system has not achieved significant commercial success.

In application Ser. No. 09/144,607, filed Aug. 31, 1998, catalytic materials are described for use in the catalytic cracking process which are capable of reducing the content of the liquid products of the cracking process. These sulfur reduction catalysts comprise, in addition to a porous molecular sieve component, a metal in an oxidation state above zero within the interior of the pore structure of the sieve. The molecular sieve is in most cases a zeolite and it may be a zeolite having characteristics consistent with the large pore zeolites such as zeolite beta or zeolite USY or with the intermediate pore size zeolites such as ZSM-5. Non-zeolitic molecular sieves such as MeAPO-5, MeAPSO-5, as well as the mesoporous crystalline materials such as MCM-41 may be used as the sieve component of the catalyst. Metals such as vanadium, zinc, iron, cobalt, and gallium were found to be effective for the reduction of sulfur in the gasoline, with vanadium being the preferred metal. The amount of the metal component in the sulfur reduction additive catalyst is normally from 0.2 to 5 weight percent, but amounts up to 10 weight percent were stated to give some sulfur removal effect. The sulfur reduction component may be a separate particle additive or part of an integrated cracking/sulfur reduction catalyst. When used as a separate particle additive catalyst, these materials are used in combination with an active catalytic cracking catalyst (normally a faujasite such as zeolite Y and REY, especially as zeolite USY and REUSY) to process hydrocarbon feedstocks in the FCC unit to produce low-sulfur products.

In application Ser. Nos. 09/221,539 and 09/221,540, both filed Dec. 28, 1998, sulfur reduction catalyst similar to the one described in application Ser. No. 09/144,607 were described, however, the catalyst compositions in those applications also comprise at least one rare earth metal component (e.g. lanthanum) and a cerium component, respectively. The amount of the metal component in the sulfur reduction catalysts is normally from 0.2 to 5 weight percent, but amounts up to 10 weight percent were suggested to give some sulfur removal effect.

In application Ser. No. 09/399,637, filed Sep. 20, 1999, an improved catalytic cracking process for reducing the sulfur content of the liquid cracking products, especially cracked gasoline, produced from hydrocarbon feed containing organosulfur compounds is described. The process employs a catalyst system having a sulfur reduction component containing porous catalyst and a metal component in an oxidation state greater than zero. The sulfur reduction activity of the catalyst system is increased by increasing average oxidation state of the metal component by an oxidation step following conventional catalyst regeneration. The catalyst is normally a molecular sieve such as zeolite Y, REY, USY, RESUY, Beta or ZSM-5. Non-zeolitic molecular sieves such as MeAPO-5, MeAPSO-5, as well as the mesoporous crystalline materials such as MCM-41 and MCM-48 may also be used as the sieve component of the catalyst. Amorphous and paracrystalline materials such as amorphous refractory inorganic oxides of Group 2, 4, 13 and 14 of the periodic table, for example, $Al_2O_3$, $SiO_2$, $ZrO_2$, $TiO_2$, MgO and mixtures thereof, and paracrystalline materials such as transitional aluminas, are also contemplated as useful support components for the metal component of the sulfur reduction catalysts. The metal component is normally a metal of Groups 5, 7, 8, 9, 12 or 13 of the Periodic Table, preferably vanadium or zinc. The amount of metal in the sulfur reduction component is normally from 0.1 to 10 weight percent (as metal, relative to the weight of the support component), however, amounts up to 10 weight percent were stated to have some sulfur removal effect. The sulfur reduction component may be a separate particle additive or part of an integrated cracking/sulfur reduction catalyst. A system for increasing the oxidation state of the metal component of a gasoline sulfur reduction additive is also described.

There continues to exist a need for effective ways to further reduce the sulfur content of gasoline and other liquid cracking products. The present invention was developed in response to this need.

SUMMARY OF THE INVENTION

The present invention is directed to sulfur reduction additive materials for use in a catalytic cracking process which materials are capable of improving the reduction in the sulfur content of liquid products produced by the cracking process, in particular, the gasoline and middle distillate cracking fractions. The present sulfur reduction additives are similar to additives described in application Ser. Nos. 09/144,607, 09/221,539 and 09/221,540, in that the additive materials employ a sulfur reduction component containing a metal component in an oxidation state greater than zero, i.e. vanadium. The sulfur reduction component in application Ser. Nos. 09/144,607, 09/221,539 and 09/221,540 comprises a molecular sieve (preferably, a zeolitic molecular sieve) which contains a metal component in an oxidation state above zero, i.e. vanadium, within the interior of the pore structure. In contrast, the sulfur reduction additives of the present invention, comprise a non-molecular sieve support material which contains a relatively high content of vanadium metal. It has been have found that the use of a non-molecular sieve catalyst support in combination with a relatively high concentration of vanadium enhances the rate of transport of vanadium over the entire FCC catalyst inventory, thereby increasing the activity of the catalyst to remove sulfur.

According to the present invention, the sulfur reduction additives comprise a non-molecular sieve catalyst support material containing a high content of vanadium in an oxidation state greater than zero. The support material may be organic or inorganic in nature and may be porous or non-porous. Preferably, the support material is an amorphous or paracrystalline inorganic oxide such as, for example, $Al_2O_3$, $SiO_2$, clays or mixtures thereof. The sulfur reduction additives are used as a separate particle additive in combination with the conventional catalytic cracking catalyst (normally a faujasite such as zeolite Y) to process hydrocarbon feedstocks in the fluid catalytic cracking (FCC) unit to produce low-sulfur gasoline and other liquid cracking products, such as, for example, light cycle oil that can be used as a low sulfur diesel blend component or as heating oil.

Accordingly, it is an advantage of the present invention to provide sulfur reduction additive compositions which provide improved liquid product sulfur reduction when compared to the sulfur reduction activity of a base FCC catalyst conventionally used in the catalyst cracking process.

It is also an advantage of the present invention to provide high vanadium containing sulfur reduction additive compositions which allow for the rapid dispersion of vanadium over the entire cracking catalyst inventory used in a catalytic cracking process, thereby enhancing the removal of sulfur components from cracked hydrocarbon products.

An additional advantage of the present invention is to provide sulfur reduction additive compositions having improved product sulfur reduction at lower additive levels than heretoafore used for conventional sulfur reduction additives, including vanadium/zeolite sulfur reduction additives disclosed in related application Ser. Nos. 09/144,607, 09/221,539 and 09/221,540.

DETAIL DESCRIPTION OF THE INVENTION

For purposes of this invention the term "high vanadium content" or "high content of vanadium" is used herein to indicate a vanadium content of greater than 1.5 weight percent (as metal, relative to the total weight of the additve material).

The term "molecular sieve" is used herein to designate a class of polycrystalline materials that exhibits selective sorption properties which separates components of a mixture on the basis of molecular size and shape differences, and have pores of uniform size, i.e., from about 3 Å to approximately 100 Å, which pore sizes are uniquely determined by the unit structure of the crystals. Materials such as activated carbons, activated alumina and silica gels are specifically excluded since they do not possess an ordered crystalline structure and consequently have pores of a non-uniform size. The distribution of the pore diameters of such material may be narrow (generally from about 20 Å to about 50 Å) or wide (ranging from about 20 Å to several thousand Å) as in the case for some activated carbons. See R. Szostak, Molecular Sieves: Principles of Synthesis and Identification, pp. 1–4 and D. W. Breck, Zeolite Molecular Sieves, pp. 1–30. A molecular sieve framework is based on an extensive three-dimensional network of oxygen atoms containing generally tetrahedral type-sites. In addition to the $Si^{+4}$ and $Al^{+3}$ that compositionally define a zeolite molecular sieves, other cations also can occupy these sites. These need not be iso-electronic with $Si^{+4}$ or $Al^{+3}$, but must have the ability to occupy framework sites. Cations presently known to occupy these sites within molecular sieve structures include but are not limited to Be, Mg, Zn, Co, Fe, Mn, Al, B, Ga, Fe, Cr, Si. Ge, Mn, Ti, and P. Another class of materials intended to fall within the scope of molecular sieve includes mesoporous crystalline materials exemplified by the MCM-41 and MCM-48 materials. These mesoporous crystalline materials are described in U.S. Pat. Nos. 5,098,684; 5,102,643; and 5,198,203.

In accordance with the present invention, the sulfur content of the gasoline portion of the liquid cracking products, is effectively brought to lower and more acceptable levels by carrying out the catalytic cracking in the presence of the sulfur reduction additives comprising a high content of vanadium incorporated into a non-molecular sieve catalyst support material. While the mechanism by which the high vanadium-containing additives act to enhance removal of sulfur components normally present in cracked hydrocarbon products is not precisely understood, it is believed that the additive acts to rapidly transport vanadium over the entire cracking catalyst inventory. Such an increased dispersion of vanadium permits a more efficient rate of removal of liquid product sulfur than obtainable when using a base or conventional cracking catalyst alone or in combination with conventional sulfur reduction additives heretoafore used in catalyst cracking processes.

FCC Process

The present sulfur removal additives are used as a component of the circulating inventory of catalyst in the catalytic cracking process, which these days is almost invariably the FCC process. For convenience, the invention will be described with reference to the FCC process although the present additives could be used in the older moving bed type (TCC) cracking process with appropriate adjustments in particle size to suit the requirements of the process. Apart from the addition of the present additive to the catalyst inventory and some possible changes in the product recovery section, discussed below, the manner of operating the process will remain unchanged. Thus, conventional FCC catalysts may be used, for example, zeolite based catalysts with a faujasite cracking component as described in the seminal review by Venuto and Habib, *Fluid Catalytic Cracking with Zeolite Catalysts,* Marcel Dekker, New York 1979, ISBN 0-8247-6870-1 as well as in numerous other sources such as Sadeghbeigi, *Fluid Catalytic Cracking Handbook,* Gulf Publ. Co. Houston, 1995, ISBN 0-88415-290-1.

Somewhat briefly, the fluid catalytic cracking process in which the heavy hydrocarbon feed containing the organosulfur compounds will be cracked to lighter products takes place by contact of the feed in a cyclic catalyst recirculation cracking process with a circulating fluidizable catalytic cracking catalyst inventory consisting of particles having a size ranging from about 20 to about 100 microns. The significant steps in the cyclic process are:

(i) the feed is catalytically cracked in a catalytic cracking zone, normally a riser cracking zone, operating at catalytic cracking conditions by contacting feed with a source of hot, regenerated cracking catalyst to produce an effluent comprising cracked products and spent catalyst containing coke and strippable hydrocarbons;

(ii) the effluent is discharged and separated, normally in one or more cyclones, into a vapor phase rich in cracked product and a solids rich phase comprising the spent catalyst;

(iii) the vapor phase is removed as product and fractionated in the FCC main column and its associated side columns to form liquid cracking products including gasoline;

(iv) the spent catalyst is stripped, usually with steam, to remove occluded hydrocarbons from the catalyst, after which the stripped catalyst is oxidatively regenerated to produce hot, regenerated catalyst which is then recycled to the cracking zone for cracking further quantities of feed.

The present sulfur reduction additives are used in the form of a separate particle additive which is added to the main cracking catalyst in the FCCU. The cracking catalyst will normally be based on a faujasite zeolite active cracking component, which is conventionally zeolite Y in one of its forms such as calcined rare-earth exchanged type Y zeolite (CREY), the preparation of which is disclosed in U.S. Pat. No. 3,402,996, ultrastable type Y zeolite (USY) as disclosed in U.S. Pat. No. 3,293,192, as well as various partially exchanged type Y zeolites as disclosed in U.S. Pat. Nos. 3,607,043 and 3,676,368. The active cracking component is routinely combined with a matrix material such as alumina in order to provide the desired mechanical characteristics (attrition resistance etc.) as well as activity control for the very active zeolite component or components. The particle size of the cracking catalyst is typically in the range of 10 to 120 microns for effective fluidization. As a separate particle additive, the sulfur reduction additive is normally selected to have a particle size comparable with that of the cracking catalyst so as to prevent component separation during the cracking cycle. In general the particle size of the sulfur reduction additive is in the range of about 10 to about 200 microns, preferably, about 20 to about 120 microns.

Sulfur Reduction Component

According to the present invention, the sulfur reduction additives comprise on-molecular sieve support materials having a high content of vanadium. In one embodiment of the invention, the support materials are amorphous and paracrystalline support materials, such as refractory inorganic oxides of Groups 4, 13 and 14 of the Periodic Table. Suitable refractory inorganic oxides include, but are not limited to, $Al_2O_3$, $SiO_2$, $TiO_2$, clay (e.g. kaolin, bentonite, hectorite, montmorillonite and the like) and mixtures thereof. Preferably, the support materials are selected from the group consisting of $Al_2O_3$, $SiO_2$, clay (preferably kaolin) and mixtures thereof. Most preferably, the support material is alumina.

In another embodiment of the invention, the support material is an activated carbon. Support materials in accordance with the invention may be used alone or in combination to prepare sulfur reduction additives in accordance with the invention.

The amount of vanadium metal contained in sulfur reduction additives in accordance with the invention catalyst is normally from about 2.0 to about 20 weight percent, typically from about 3 to about 10 weight percent, most preferably from about 5 to about 7 weight percent (metal, based on the total weight of the additive). Vanadium may be added to the support in any suitable manner sufficient to adsorb and/or absorb a suitable vanadium containing compound onto or into the support material.

In one embodiment, the sulfur reduction additives are prepared by treating the support material with an aqueous or non-aqueous solution of a suitable vanadium compound to impregnate the vanadium compound into or onto the surface of the support material. Alternatively, vanadium maybe added to the support by spray drying an aqueous slurry containing the support material and the desired vanadium compound. Non-limiting example of suitable vanadium compounds useful to prepare additives in accordance with the invention include, but are not limited to, vanadium oxalate, vanadium sulfate, organometallic vanadium complexes (e.g. vanadyl naphthenate), vanadium halides and oxyhalides (e.g. vanadium chlorides and oxychorides) and mixtures thereof.

Following addition of the vanadium component, the support material is dried and calcined, typically at temperatures ranging from about 100 to about 800° C.

Sulfur Reduction Catalyst Use

The sulfur reduction additives of the invention are used as separate particle additives to permit optimization of the transport of vanadium to the cracking catalyst inventory. Generally, the additives of the invention are used in an amount sufficient to increase the amount of vanadium on the cracking catalyst by about 100 to about 10,000 ppm, preferably about 500 to about 5000 ppm, most preferably about 1000 to about 2000 ppm, relative to the amount of vanadium initially present on the cracking catalyst. As will be understood by one skilled in the art, the amount of vanadium transported from the additive to the catalyst is readily determined by separating the additive from the cracking catalyst by skeletal density differences and analyzing each fraction for vanadium content after subjection to catalytic cracking condition in the presence of the additive.

The sulfur reduction additive is typically used in an amount from about 0.1 to about 10 weight percent of the cracking catalyst inventory in the FCCU; preferably, the amount will be from about 0.5 to about 5 weight percent. About 2 weight percent represents a norm for most practical purposes. The additive may be added in the conventional manner, with make-up catalyst to the regenerator or by any other convenient method. The additive remains active for sulfur removal for extended periods of time although very high sulfur feeds may result in loss of sulfur removal activity in shorter times.

Other catalytically active components may be present in the circulating inventory of catalytic material in addition to the cracking catalyst and the sulfur removal additive. Examples of such other materials include the octane enhancing catalysts based on zeolite ZSM-5, CO combustion promoters based on a supported noble metal such as platinum, stack gas desulfurization additives such as DESOX™ (magnesium aluminum spinel), vanadium traps and bottom cracking additives, such as those described in Krishna, Sadeghbeigi, op cit and Scherzer, *Octane Enhancing Zeolitic FCC Catalysts,* Marcel Dekker, New York, 1990, ISBN 0-8247-8399-9. These other components may be used in their conventional amounts.

The effect of the present additives is to reduce the sulfur content of liquid cracking products, especially the light and heavy gasoline fractions, although reductions are also noted in the light cycle oil, making them more suitable for use as a diesel or home heating oil blend component. The sulfur removed by the use of the FCC catalyst is converted to the inorganic form and released as hydrogen sulfide which can be recovered in the normal way in the product recovery section of the FCCU in the same way as the hydrogen sulfide conventionally released in the cracking process. The increased load of hydrogen sulfide may impose additional sour gas/water treatment requirements but with the significant reductions in gasoline sulfur achieved, these are not likely to be considered limitative.

Very significant reductions in gasoline sulfur can be achieved by the use of the present catalysts, in some cases up to about 80% relative to the base case using a conventional cracking catalyst, at constant conversion, using the preferred form of the catalyst described above. Gasoline sulfur reduction of 10 to 60% is readily achievable with additives according to the invention, as shown by the Examples below. The extent of sulfur reduction may depend on the original organic sulfur content of the cracking feed, with the greatest reductions achieved with the higher sulfur feeds. Sulfur reduction may be effective not only to improve product quality but also to increase product yield in cases where the refinery cracked gasoline end point has been limited by the sulfur content of the heavy gasoline fraction; by providing an effective and economical way to reduce the sulfur content of the heavy gasoline fraction, the gasoline end point may be extended without the need to resort to expensive hydrotreating, with a consequent favorable effect on refinery economics. Removal of the various thiophene derivatives which are refractory to removal by hydrotreating under less severe conditions is also desirable if subsequent hydrotreatment is contemplated.

In order to further illustrate the present invention and the advantages thereof, the following specific examples are given. The examples are given as specific illustrations of the claimed invention. It should be understood, however, that the invention is not limited to the specific details set forth in the examples. All part and percentages in the examples as well as the remainder of the specification are by weight unless otherwise specified.

The scope of the invention is not in any way intended to be limited by the examples set forth below. The examples include the preparation of sulfur reduction additives in accordance with the invention and evaluations of the performance of the additives to reduce sulfur in a catalytic cracking environment.

EXAMPLES

Example 1

Preparation of 2% Vanadium and 5% Vanadium on an $Al_2O_3$, Support

A spray dried $Al_2O_3$ particle was prepared by peptizing a psuedoboehmite $Al_2O_3$ slurry with HCl, milling it with a Drais mill and then spray drying the milled slurry. The resulting spray dried alumina was calcined for 1 hour at 800° C.

The spray dried, calcined $Al_2O_3$, was then impregnated to incipient wetness with an aqueous vanadium oxalate solution. The concentration of vanadium oxalate in the solution was adjusted to produce a concentration of 2 wt % V and 5 wt % V on alumina.

The impregnated alumina was dried at 100° C. and then calcined for 2 hours at 540° C.

Example 2

Preparation of 6% V on an $Al_2O_3$ Support

A spray dried, calcined $Al_2O_3$, prepared as described in Example 1 above, was impregnated to incipient wetness with an aqueous vanadium sulfate solution. The concentration of vanadium sulfate in solution was adjusted to produce 6 wt % V on alumina.

The impregnated material was dried at 120° C. The final material was analyzed by ICP and found to contain 5.4 wt % V, 0.1 wt % $Na_2O$, 11% $SO_4$. The surface area, as determined by $N_2$-BET, was 39 $m^2/g$.

Example 3

Preparation of 2.0% V on a $SiO_2$-Clay Support

A silica hydrogel (280–350 $m^2/g$, 30–35% solids and 8.0–8.5 pH) was slurried in distilled water and sand milled to give a slurry which contained 14.8 wt % solids. A mixture of 13,514 g of the milled silica hydrogel slurry, 2500 g of Nalco Grade 1140 colloidal $SiO_2$ and 2353 g of Natka clay were Drais milled and spray dried. The spray-dried samples were then calcined for 40 minutes at 700° C.

300 g of the calcined, spray dried sample was impregnated with an aqueous solution of vanadium sulfate to give 2 wt % V. After impregnation the sample was dried at 120° C. The final material was analyzed by ICP and found to contain 2.0 wt % V, 0.39 wt % $Na_2O$, 4.2% $SO_4$. The surface area, as determined by $N_2$-BET, was 115 $m^2/g$.

Example 4

Preparation of 0.42% Vanadium/Zeolite Additive

A vanadium,/zeolite catalyst was prepared by spray-drying a slurry of 50% USY, 30% clay and 20% silica sol. The spray-dried material was ammonium exchanged to remove the $Na^+$, rare earth exchanged and then dried at 100° C. Vanadium was added by impregnation of the catalyst to incipient wetness using an aqueous vanadium oxalate solution. The amount of vanadium oxalate in solution was adjusted to a target of 0.4 wt %.

The final material was analyzed by ICP and found to contain 0.42 wt % V, 3.8 wt % $RE_2O_3$ and 0.27 wt % $Na_2O$. The surface area as determined by $N_2$-BET, was 375 $m^2/g$.

Example 5

Catalytic Evaluation of Vanadium Supported on $Al_2O_3$

The $V/Al_2O_3$, additives from Example 1 were blended with a commercial FCC catalyst and steam deactivated in a fluidized bed for 4 hours at 1500° F. in 100% steam. The additive/FCC catalyst blends were designed so that the blend contained 1000 ppm V (95 wt % FCC Catalyst/5 wt % of 2% $V/Al_2O_3$ additive; and 98 wt % FCC Catalyst/2 wt % of 5% $V/Al_2O_3$ additive).

The additive/FCC catalyst blends were tested for gas oil cracking activity and selectivity using an ASTM Microactivity Test ("MAT") (ASTM procedure D-3907). The liquid product from each run was analyzed for sulfur using a gas chromatograph with an Atomic Emission Detector (GC-AED). Analysis of the liquid products with the GC-AED allows each of the sulfur species in the gasoline region to be quantified. For purposes of this example, the cut gasoline will be defined as $C_5$ to $C_{12}$ hydrocarbons that have a boiling point up to 430° F. The sulfur species included in the cut of gasoline range include thiophene, tetrahydrothiophene, $C_1$–$C_5$ alkylated thiophenes and a variety of aliphatic sulfur species. Benzothiophene is not included in the cut gasoline range. The properties of the gas oil feed used in the MAT test are shown in the Table 1.

TABLE 1

| Properties of Vacuum Gas Oil Feed | |
|---|---|
| API Gravity | 26.6 |
| Aniline Point, ° F. | 182 |

TABLE 1-continued

| Properties of Vacuum Gas Oil Feed | |
|---|---|
| CCR, wt % | 0.23 |
| Sulfur, wt % | 1.05 |
| Nitrogen, ppm | 600 |
| Basic Nitrogen, ppm | 310 |
| Ni, ppm | 0.32 |
| V, ppm | 0.68 |
| Fe, ppm | 9.15 |
| Cu, ppm | 0.05 |
| Na, ppm | 2.93 |
| Distillation | |
| IBP, ° F. | 358 |
| 50 wt %, ° F. | 716 |
| 99.5 wt %, ° F. | 1130 |

The MAT data for the catalysts is shown in the Table 2; where the product selectivity was interpolated to a constant conversion of 70 wt %. The first column shows the FCC catalyst without the vanadium-based sulfur reduction additive. The next two columns show FCC catalyst blended with the 2 wt % V and 5 wt % V additives, respectively. The data shows that both vanadium additives decrease cut gasoline range sulfur 55–65% as compared to the base FCC catalyst. The coke and $H_2$ increase modestly for the samples that contain the vanadium additives.

TABLE 2

| MAT Product catalyst Yields | Base FCC Catalyst | 95 wt % FCC Catalyst 5 wt % (2% $V/Al_2O_3$) | 98 wt % FCC 2 wt % (5% $V/Al_2O_3$) |
|---|---|---|---|
| Conversion | 70 | 70 | 70 |
| Cat/Oil | 2.8 | 3.5 | 3.6 |
| H2 Yields, wt % | 0.06 | 0.20 | 0.22 |
| C1 + C2 Gas, wt % | 1.40 | 1.55 | 1.58 |
| Total C3 Gas, wt % | 4.97 | 4.97 | 5.02 |
| Propylene, wt % | 4.06 | 4.06 | 4.10 |
| Total C4 Gas, wt % | 9.96 | 10.02 | 9.94 |
| C5 + gasoline, wt % | 51.07 | 49.83 | 50.17 |
| LCO, wt % | 25.77 | 25.85 | 25.90 |
| Bottoms, wt % | 4.13 | 4.10 | 4.20 |
| Coke, wt % | 2.55 | 3.11 | 3.18 |
| Cut Gasoline S, ppm | 263 | 112 | 98 |
| % Reduction in Cut Gasoline Sulfur | Base | 57% | 63% |

Example 6

Catalytic Evaluation of $V/Al_2O_3$ Steamed Deactivated Together and Separately from the FCC Catalyst The need for transport of vanadium from the additive to the catalyst during deactivation in order to achieve good cut gasoline sulfur reduction is demonstrated in this example. The 6% $V/Al_2O_3$ additive from Example 2 was blended at a 4 wt % level with a FCC equilibrium catalyst (120 ppm V and 60 ppm Ni) and mildly steam deactivated for 20 hours at 1350° F. in 25% steam to simulate catalytic cracking conditions.

Separation of the additive from Ecat by skeletal density differences and analysis of the fractions by ICP shows that on the ECAT fraction, the vanadium content has increased from 120 ppm V to 2360 ppm V during the steaming process. A comparison example was made by steam deactivating the Ecat and the 6% $V/Al_2O_3$, additive each separately, for 20 hours at 1350° F. in 25% steam, and then blending the additive at a 4 wt % level. The base case Ecat was also steamed for 20 hours at 1350° F. in 25% steam. The steam deactivated Ecat and the Additive/FCC catalyst blends were tested for gas oil cracking and selectivity using ASTM Microactivity Test ("MAT")(ASTM procedure D-3907) as described in Example 5. The properties of the gas oil used in this example are shown in Table 1.

The MAT data for the catalyst is shown in the Table 3, where the product selectivity was interpolated to a constant conversion of 70 wt %. The first column shows data for the FCC Ecat without the vanadium based sulfur reduction additive. The second column shows data for the FCC Ecat steamed together with the $V/Al_2O_3$ additive. The third column shows data for the FCC Ecat and $V/Al_2O_3$, additive steamed separately and then blended together. The data shows that when the additive is steamed together with the FCC catalyst (as typical of catalytic cracking process conditions) vanadium is transported from the additive to the catalyst to provide a substantial cut in gasoline sulfur reduction. The coke and $H_2$ increased modestly for the samples that contain the vanadium additives.

TABLE 4

| Properties of Vacuum Gas Oil Feed | |
|---|---|
| API Gravity | 25.3 |
| Aniline Point, ° F. | 178 |
| CCR, wt % | 0.21 |
| Sulfur, wt % | 1.04 |
| Nitrogen, ppm | 700 |
| Basic Nitrogen, ppm | 308 |
| Ni, ppm | 0.2 |
| V, ppm | 0.4 |
| Fe, ppm | 3.7 |
| Cu, ppm | 0 |
| Na, ppm | 0 |
| Distillation | |
| IBP, ° F. | 309 |
| 50 wt %, ° F. | 748 |
| 99.5 wt %, ° F. | 1063 |

TABLE 3

| MAT Product Yield | Base Equilibrium Catalyst | 96 wt % FCC ECAT 4 wt % (6% $V/Al_2O_3$) Steamed Together | 96 wt % FCC ECAT 4 wt % (6% $V/Al_2O_3$) Steamed Separately |
|---|---|---|---|
| Conversion | 70 | 70 | 70 |
| Cat/Oil | 3.70 | 4.26 | 4.26 |
| H2 Yields, wt % | 0.04 | 0.09 | 0.10 |
| C1 + C2 Gas, wt % | 1.37 | 1.50 | 1.45 |
| Total C3 Gas, wt % | 5.07 | 5.29 | 5.15 |
| Propylene, wt % | 4.38 | 4.58 | 4.45 |
| Total C4 Gas, wt % | 10.02 | 10.44 | 10.15 |
| C5 + gasoline, wt % | 50.94 | 49.76 | 50.10 |
| LCO, wt % | 25.38 | 25.21 | 25.16 |
| Bottoms, wt % | 4.42 | 4.57 | 4.57 |
| Coke, wt % | 2.13 | 2.48 | 2.54 |
| Cut Gasoline S, ppm | 525 | 359 | 521 |
| % Reduction in Cut Gasoline Sulfur | Base | 32 | 1 |

Example 7

Catalytic Evaluation of Vanadium Supported on SiO2/Clay

The 2% $V/SiO_2$/Clay additive from Example 3 was blended at a 5% level with a FCC Ecat (120 ppm V and 60 ppm Ni) and mildly steam deactivated for 20 hours at 1350° F. in 25% steam. As a comparison, the base Ecat was also deactivated under those conditions. The steam deactivated base Ecat and the additive FCC blends were tested for gas oil cracking activity and selectivity using an ASTM Microactivity Test (ASTM procedure D-3907) as described in Example 5. The properties of the gas oil used in this example are shown in Table 4.

The MAT data for the catalysts is shown in Table 5, where the product selectivity was interpolated to a constant conversion of 70 wt %. The data shows that the $V/SiO_2$/Clay additive decreases cut gasoline sulfur 42% as compared to the base case Ecat.

TABLE 5

| MAT Product Yields | Base Ecat | 95% Ecat 5%[2% $V/SiO_2$/Clay] |
|---|---|---|
| Conversion | 70 | 70 |
| Cat/Oil | 3.64 | 4.05 |
| H2 Yield | 0.05 | 0.10 |
| C1 + C2 Gas | 1.33 | 1.39 |
| Total C3 Gas, wt % | 4.53 | 4.58 |
| Total C4 Gas, wt % | 9.69 | 9.39 |
| C5 + gasoline, wt % | 51.86 | 51.56 |
| LCO, wt % | 24.61 | 23.97 |
| Bottoms, wt % | 5.31 | 5.44 |
| Coke, wt % | 2.26 | 2.53 |
| Cut Gasoline S, ppm | 616 | 361 |
| % Reduction in Cut Gasoline Sulfur | Base | 42 |

Example 8

Catalytic Cracking Performance of 6% V/Alumina Versus V/Zeolite Catalyst

This example shows the utility of the high vanadium-containing additive in circulating FCC riser/regenerator pilot plant testing. The high vanadium-containing additive described in Example 2 was tested in a Davison Circulating Riser pilot plant with a commercial FCC feed and equilibrium catalyst. For comparison, the vanadium/zeolite additive described in Example 4 was also tested. The equilibrium catalyst contained 332 ppm Ni and 530 ppm V. The feed properties are shown in Table 6. The DCR was operated with a riser temperature of 980° F. and a regenerator temperature of 1300° F. All the liquid products were analyzed by GC-AED for gasoline sulfur levels.

The testing results are shown in Table 7. The high vanadium-containing additive tested at a 2 wt % additive level gave 33% cut gasoline sulfur reduction as compared to the base Ecat. The vanadium/zeolite additive decreased cut gasoline sulfur 13% when used at the 22% additive level and 26% when used at the 50% additive level. The coke and hydrogen yields were marginally higher for the high vanadium-containing additive than for the base case Ecat.

TABLE 6

| Properties of Vacuum Gas Oil Feed | |
|---|---|
| API Gravity | 23.9 |
| Aniline Point, ° F. | 186 |
| CCR, wt % | 0.62 |
| Sulfur, wt % | 1.50 |
| Nitrogen, ppm | 1000 |
| Basic Nitrogen, ppm | 140 |
| Ni, ppm | 0.3 |
| V, ppm | 0.3 |
| Fe, ppm | 0.7 |
| Cu, ppm | 0 |
| Na, ppm | 0.9 |
| Distillation | |
| IBP, ° F. | 429 |
| 50 wt %, ° F. | 783 |
| 99.5 wt %, ° F. | 1292 |

TABLE 7

| DCR Product Yields | Base FCC Catalyst | 78 wt % FCC Cat. 22% V/Zeolite Cat. | 50 wt % FCC Cat. 50% V/Zeolite Cat. | 98 wt % FCC Cat. 2% (6% V/$Al_2O_3$) |
|---|---|---|---|---|
| Conversion | 72 | 72 | 72 | 72 |
| Cat/Oil | 6.69 | 6.47 | 6.61 | 7.92 |
| H2 Yield | 0.03 | 0.04 | 0.05 | 0.08 |
| C1 + C2 Gas | 2.41 | 2.53 | 2.63 | 2.37 |
| Total C3 Gas, wt % | 6.68 | 6.59 | 6.66 | 6.29 |
| Total C4 Gas, wt % | 12.41 | 12.06 | 12.24 | 11.79 |
| C5 + gasoline, wt % | 45.95 | 46.11 | 45.51 | 46.20 |
| LCO, wt % | 20.59 | 20.28 | 20.15 | 20.66 |
| Bottoms, wt % | 7.41 | 7.72 | 7.85 | 7.34 |
| Coke, wt % | 4.11 | 4.02 | 4.24 | 4.58 |
| Cut Gasoline S, ppm | 877 | 765 | 651 | 589 |
| % Reduction in Cut Gasoline Sulfur | Base case | 13 | 26 | 33 |

Reasonable variations and modifications, which will be apparent to those skilled in the art, can be made in this invention without departing from the spirit and scope thereof.

We claim:

1. A method of reducing the sulfur content of a liquid catalytically cracked petroleum fraction, which comprises catalytically cracking a petroleum feed fraction containing organosulfur compounds at elevated temperature in the presence of an equilibrium cracking catalyst and a product sulfur reduction additive to produce liquid cracking products of reduced sulfur content, wherein the product sulfur additive consists essentially of vanadium and a support selected from the group consisting of a refractory inorganic oxide and activated carbon.

2. A method according to claim 1 wherein said support comprises a refractory inorganic oxide selected from the group consisting of alumina, silica, titania, clay and mixtures thereof.

3. A method according to claim 1 in which the equilibrium cracking catalyst comprises a large pore size zeolite.

4. A method according to claim 3 in which the large pore size zeolite comprises a faujasite.

5. A method according to claim 2 in which the refractory inorganic oxide is selected from the group consisting of alumina, silica, clay and mixtures thereof.

6. A method according to claim 5 in which the refractory inorganic oxide is alumina.

7. A method according to claim 1 in which the product sulfur reduction additive contains from about 2 to about 20 weight percent, based on the total weight of the additive, of vanadium.

8. A method according to claim 7 in which the product sulfur reduction additive contains from about 5 to about 10 weight percent, based on the total weight of the additive, of vanadium.

9. A method according to claim 1 in which vanadium has been impregnated onto the surface of the support.

10. A method according to claim 1 in which vanadium has been incorporated into the support.

11. A method according to claim 1 in which the sulfur reduction additive is a separate particle.

12. In a fluid catalytic cracking process in which a heavy hydrocarbon feed comprising organosulfur compounds is catalytically cracked to lighter products by contact in a cyclic catalyst cracking process with a circulating equilibrium cracking catalyst inventory consisting of particles having a size ranging from about 20 to about 100 microns, comprising:

(i) catalytically cracking the feed in a catalytic cracking zone operating at catalytic cracking conditions by contacting feed with a source of regenerated equilibrium cracking catalyst to produce a cracking zone effluent comprising cracked products and spent catalyst containing coke and strippable hydrocarbons;

(ii) discharging and separating the effluent mixture into a cracked product rich vapor phase and a solids rich phase comprising spent catalyst;

(iii) removing the vapor phase as a product and fractionating the vapor to form liquid cracking products including gasoline, (iv) stripping the solids rich spent catalyst phase to remove occluded hydrocarbons from the catalyst, (v) transporting stripped catalyst from the stripper to a catalyst regenerator;

(vi) regenerating stripped catalyst by contact with oxygen containing gas to produce regenerated catalyst; and (vii) recycling the regenerated catalyst to the cracking zone to contact further quantities of heavy hydrocarbon feed, the improvement which comprises reducing the sulfur content of a the gasoline portion of the liquid cracking products, by catalytically cracking the feed fraction at elevated temperature in the presence of the equilibrium catalyst and a product sulfur reduction additive to produce liquid cracking products of reduced sulfur content, wherein the product sulfur additive comprises fluidizable particles having a size ranging from about 20 to about 100 microns and consists essentially of vanadium and a support selected from the group consisting of a refractory inorganic oxide and activated carbon.

13. A method according to claim 12 in which the support comprises a refractory inorganic oxide selected from the group consisting of alumina, silica, titania, clay and mixtures thereof.

14. A method according to claim 12 in which the equilibrium cracking catalyst comprises a matrixed faujasite zeolite.

15. A method according to claim 13 in which the support is a refractory inorganic oxide support selected from the group consisting of alumina, silica, clay and mixtures thereof.

16. A method according to claim 15 in which the refractory inorganic oxide is alumina.

17. A method according to claim 12 in which the product sulfur reduction additive contains from about 2 to about 20 weight percent, based on the total weight of the additive, of vanadium metal.

18. A method according to claim 17 in which the product sulfur reduction additive contains from about 5 to about 10 weight percent, based on the total weight of the additive, of vanadium metal.

19. A method according to claim 12 in which vanadium has been impregnated onto or into the surface of the support.

20. A method according to claim 12 in which vanadium has been added into the support.

21. A method according to claim 12 in which the sulfur reduction additive is a separate particle.

22. A method according to claim 12 in which the gasoline product of reduced sulfur content is a gasoline boiling range fraction which has a sulfur content lower than that achieved in the absence of the product sulfur reduction additive.

23. A method of reducing the sulfur content of a catalytically cracked liquid product petroleum fraction, which comprises catalytically cracking a petroleum feed fraction containing organosulfur compounds at elevated temperature in the presence of an equilibrium cracking catalyst containing vanadium in intimate contact with separate particles of at least one product sulfur reduction additive to produce liquid cracking products of reduced sulfur content, wherein the additive consists essentially of a support selected from the group consisting of a refractory inorganic oxide and activated carbon, and at least one transportable vanadium compound adsorbed and/or absorbed onto or into the support, respectively, and capable of being transported to the cracking catalyst in amounts sufficient to increase the vanadium content of the equilibrium cracking catalyst by about 100 ppm to about 10,000 ppm, relative to the amount of vanadium initially present on the equilibrium cracking catalyst, when the additive. is contacted with the equilibrium cracking catalyst under catalytic cracking conditions.

24. The method of claim 23 wherein the support comprises a refractory inorganic oxide selected from the group consisting of alumina, silica, titania, clay and mixtures thereof.

25. The method of claim 23 wherein the vanadium content of the equilibrium cracking catalyst is increased by about 500 to about 5000 pppm.

26. The method of claim 23 wherein the vanadium content of the equilibrium cracking catalyst is increased by about 1000 to about 2000 pppm.

* * * * *